US005485055A

United States Patent [19]

Keyser

[11] Patent Number: 5,485,055

[45] Date of Patent: Jan. 16, 1996

[54] ACTIVE MATRIX ELECTROLUMINESCENT DISPLAY HAVING INCREASED BRIGHTNESS AND METHOD FOR MAKING THE DISPLAY

[75] Inventor: Thomas R. Keyser, Ellicot City, Md.

[73] Assignee: AlliedSignal Inc., Morris Township, N.J.

[21] Appl. No.: 273,558

[22] Filed: Jul. 11, 1994

[51] Int. Cl.[6] ..... H01J 63/04

[52] U.S. Cl. ..... 313/505; 313/500; 445/24

[58] Field of Search ..... 313/500, 502, 313/504, 506, 507, 508, 509, 505; 445/24; 428/690

[56] References Cited

U.S. PATENT DOCUMENTS

| | | | |
|---|---|---|---|
| 2,944,177 | 7/1960 | Piper | 313/502 |
| 3,350,596 | 10/1967 | Burns | 313/108 |
| 4,066,925 | 1/1978 | Dickson | 313/503 |
| 4,163,920 | 8/1979 | Lambe et al. | 313/503 |
| 4,342,945 | 8/1982 | Ketchpel | 313/505 |
| 4,614,668 | 9/1986 | Topp et al. | 427/66 |
| 4,665,342 | 5/1987 | Topp et al. | 313/505 |
| 4,667,128 | 5/1987 | Kamijo et al. | 313/505 |
| 4,670,690 | 6/1987 | Ketchpel | 313/505 |
| 4,728,581 | 3/1988 | Kane et al. | 428/690 |
| 4,774,435 | 9/1988 | Levinson | 313/509 |
| 5,072,152 | 12/1991 | Tuenge et al. | 313/509 |
| 5,077,147 | 12/1991 | Tanaka et al. | 428/690 |
| 5,102,361 | 4/1992 | Katayama et al. | 445/4 |
| 5,162,878 | 11/1992 | Sasagawa et al. | 257/88 |
| 5,244,427 | 9/1993 | Umeya | 445/24 |
| 5,384,517 | 1/1995 | Uno | 315/169.3 |

*Primary Examiner*—Donald J. Yusko
*Assistant Examiner*—Lawrence O. Richardson
*Attorney, Agent, or Firm*—Howard G. Massung

[57] ABSTRACT

An active matrix electroluminescent display having an array of pixel electrodes disposed on a transparent substrate. Each pixel electrode having an associated electronic circuit formed intermediate the pixel electrode and the transparent substrate to which it is electrically connected. The array of pixel electrodes are overlayed with an electroluminescent stack and a transparent ITO conductive layer. The surface of each pixel electrode is uniformly texturized to enhance the brightness of the pixel element when it is activated to its luminous state by its associated electronic circuit.

10 Claims, 3 Drawing Sheets

ACTIVE MATRIX ELECTROLUMINESCENT DISPLAY HAVING INCREASED BRIGHTNESS AND METHOD FOR MAKING THE DISPLAY

TECHNICAL FIELD

The invention is related to the field of active matrix electroluminescent displays and, in particular, to active matrix electroluminescent displays having texturized pixel electrodes to increase the brightness of the display.

BACKGROUND ART

The brightness of electroluminescent devices such as taught by Burns in U.S. Pat. No. 3,350,596 or Tuenge et al in U.S. Pat. No. 5,072,152 has always been a limiting: factor in the practical use of these devices under moderate to high ambient light conditions. Many attempts have been made to increase the brightness of these devices. Levinson, in U.S. Pat. No. 4,774,435, and Kane et al in U.S. Pat. No. 4,728,581, disclose a method for increasing the brightness of an electroluminescent device in which the surface of the transparent tin oxide electrode is texturized to reduce the amount of the generated light trapped in the layered structure of the devices.

SUMMARY OF THE INVENTION

An active matrix electroluminescent display having a substrate, a plurality of electronic circuits formed on the substrate, and an array of metal pixel electrodes, each of the metal pixel electrodes being associated with one of the electronic circuits of the plurality of electronic circuits and electrically connected thereto. The surface of each pixel electrode having a texturized surface. The plurality of pixel electrodes are overlayed with an electroluminescent (EL) stack consisting of a layer of electroluminescent material sandwiched between a pair of transparent insulator layers. A transparent conductive layer is disposed on the surface of the electroluminescent stack. The pixel electrodes are uniformly texturized by etching holes, channels or grooves in the pixel electrodes, or in an insulator layer underlying the pixel electrodes, or by depositing the underlying insulator layer under conditions that promote the formation of nodules.

The advantage of the electroluminescent display is that the texturized pixel electrodes significantly enhances the brightness of the display.

Another advantage of the electroluminescent display is that the texturizing of the pixel electrodes can be controlled permitting repeated and uniform enhancement of each pixel element of the display.

These and other advantages will become more apparent from a reading of the specification in conjunction with the drawings.

DETAILED DESCRIPTION OF THE INVENTION

Figure 1:
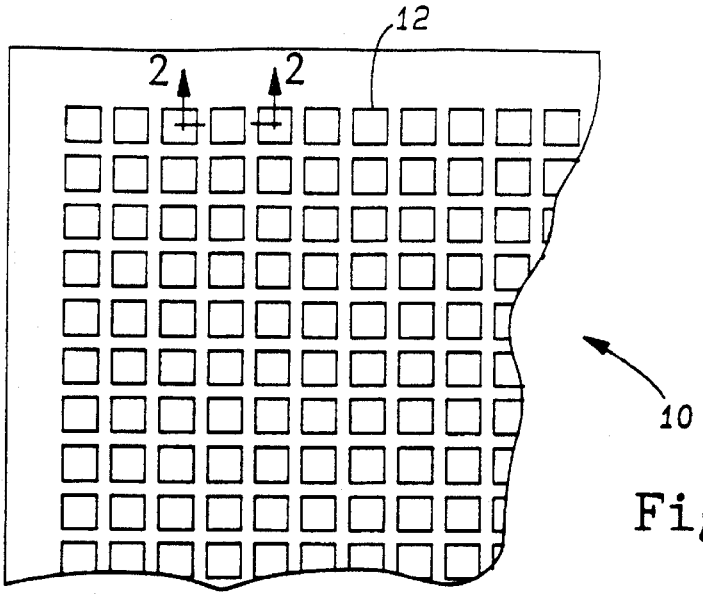
FIG. 1 shows a partial top view of the active matrix electroluminescent display.
Figure 2:
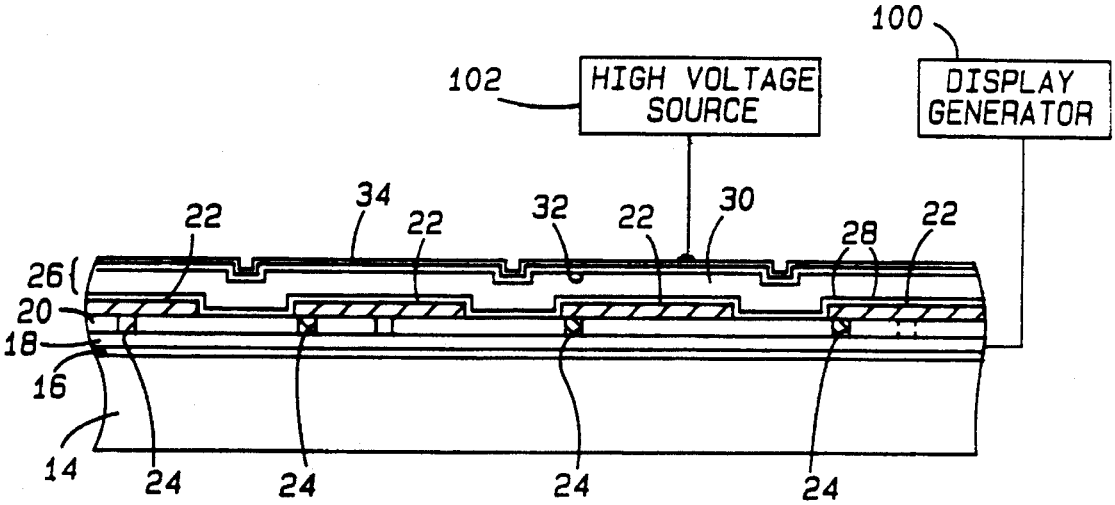
FIG. 2 is a partial cross-section of the active matrix electroluminescent display taken along section lines 2—2 in FIG. 1.

FIG. 1 shows a plan view of a portion of an active matrix electroluminescent display 10 incorporating the invention. The active matrix array has an array of pixel elements 12 preferably arranged in rows and columns as shown. FIG. 2 is a cross-section of a portion of a row of pixel elements 12 taken along cross-section line 2—2, shown in FIG. 1. The active matrix electroluminescent display 10 has a base substrate 14 on which is deposited a first insulator layer 16. The base substrate 14 may be a silicon, a glass or a quartz wafer and the first insulator layer 16 may be a layer of silicon dioxide ($SiO_2$). A silicon layer 18 may be grown on or bonded to the insulator layer 16 to form a silicon-on-insulator (SOI) structure. Alternatively, the insulating layer may be a buried oxide layer formed by implanting oxygen ions into the silicon layer 18 and annealed at a high temperature. As shall be discussed hereinafter, active semiconductor circuits are formed in the silicon layer 18 which are used to activate the individual pixel elements in response to signals received from a display generator 100.

Figure 9:
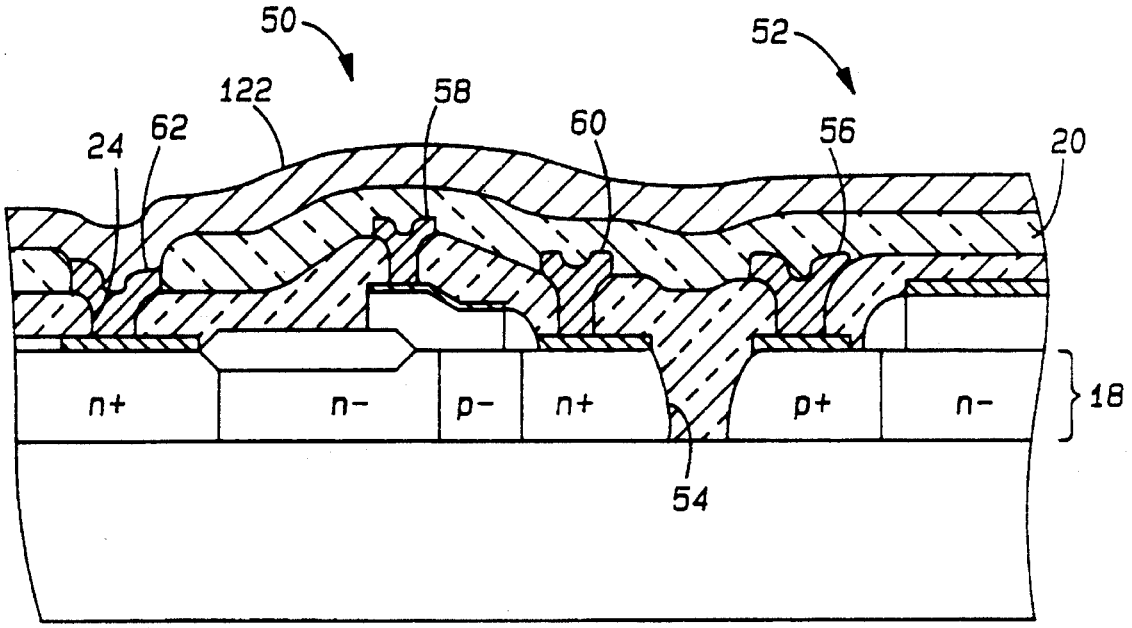
FIG. 9 is an enlarged cross-section showing the details of the silicon-on-insulator electronic devices underlying each pixel electrode.

A second insulator layer 20 is formed on the semiconductor circuits formed in the silicon layer 18 and then an array of metal pixel electrodes 22 are formed on the second insulator layer 20. Each metal pixel electrode 22 defines the active area of each pixel element 12 of the matrix electroluminescent display. Each pixel electrode 22 is connected to an associated electronics circuit formed in the silicon layer 18 via a hole 24 etched through the second insulator layer 20 prior to the deposition of the matrix of pixel electrodes 22. The etched holes 24 are formed directly over the output electrodes of the associated semiconductor circuit and permits each pixel electrode 22 to be electrically connected to the output electrode of its associated electronic circuit, as shown in FIG. 9.

An electroluminescent stack 26, consisting of a bottom insulator layer 28, an electroluminescent material layer 30, and a top insulator layer 32 is formed over the pixel electrodes 22 and the exposed surfaces of the second insulator layer 20 between the pixel electrodes 22, as shown in FIG. 2. Finally, a transparent conductive layer 34 is formed on top of the top insulator layer 32, completing the active matrix electroluminescent display. The transparent conductive layer preferably is an indium tin oxide (ITO) layer.

In operation, the transparent conductive layer 34 is provided with a high voltage received from a high voltage source 102 and may be either AC or DC. The individual pixel electrodes are selectively activated by its associated electronic circuit to produce a potential gradient between the electrode 22 and the transparent conductive layer 34 sufficient to make the layer of electroluminescent material 30 therebetween luminescent.

Normally, the potential difference between the electrodes 22 and the transparent conductive layer 34 is between 200 and 400 volts provided by the high voltage source 102. The intensity of the light produced by the individual pixels will be a function of the thickness of the layer of electroluminescent material 30, the applied potential between the pixel electrodes and the transparent conductive layer 34, and as a function of the surface texture of the individual pixel electrodes.

It has been found that the intensity of the light generated by each pixel 12 of the active matrix electroluminescent display may be enhanced by uniformly texturizing the surface of the metal pixel electrodes 22, as shown in FIGS. 3 through 7. Because the surface of each metal pixel electrode 22 is irregular as described relative to FIG. 9, it is necessary to uniformly texture the surface of the electrode so that the brightness of all the pixel elements 12 will be substantially equal.

Figure 3:
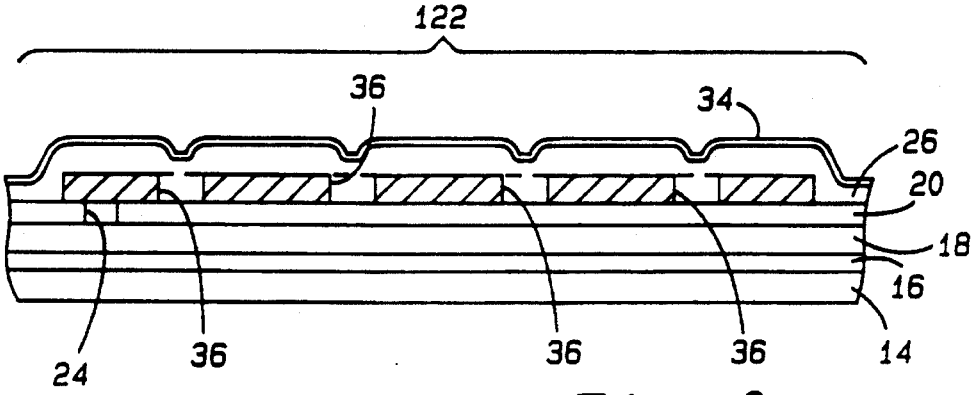
FIGS. 3–8 show various methods for texturizing the pixel electrodes.

FIG. 3 is a cross-section of a single pixel electrode 22, the surface of which is uniformly texturized by etching a plurality of holes 36 through the pixel electrode 122 as shown. The holes 36 are formed by applying an appropriate mask over each of the pixel electrodes 122 and etching the holes 36 using an appropriate mask. After the holes are etched, the mask is removed. The pixel electrode 122 with the texturized surface is connected to the associated electronic circuit formed in the silicon layer 18 below the pixel electrode 122 via the hole 24 provided through the second insulator layer 20. The electroluminescent or EL stack 26, having the same structure as described relative to FIG. 2, is formed on the texturized surface of pixel electrode 122 and the transparent conductive layer 34 is formed on the top surface of the EL stack 26. The EL stack 26 and the transparent conductive layer 34 will, in general, have a textured surface corresponding to the textured surface of the pixel electrode 122.

Figure 4:
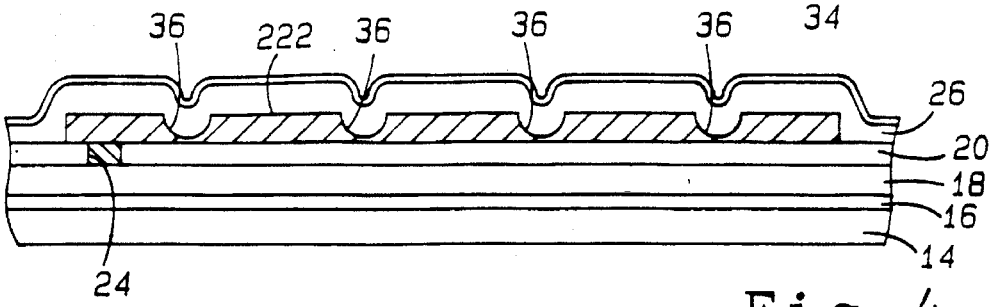

The structure of the pixel electrode 222, shown in FIG. 4, is comparable to the structure of the pixel electrode 122, shown in FIG. 3. The difference between the structure of FIG. 3 and the structure of FIG. 4 is that the holes 36' are etched only part-way through the pixel electrode 222 to provide the desired textured surface. A similar structure may be formed using a two layer metal electrode in which the holes are etched through only one of the two layers. Again, the EL stack 26 and the transparent conductive layer 34 follow the contours of the textured surface of the pixel electrode 222.

Figure 5:
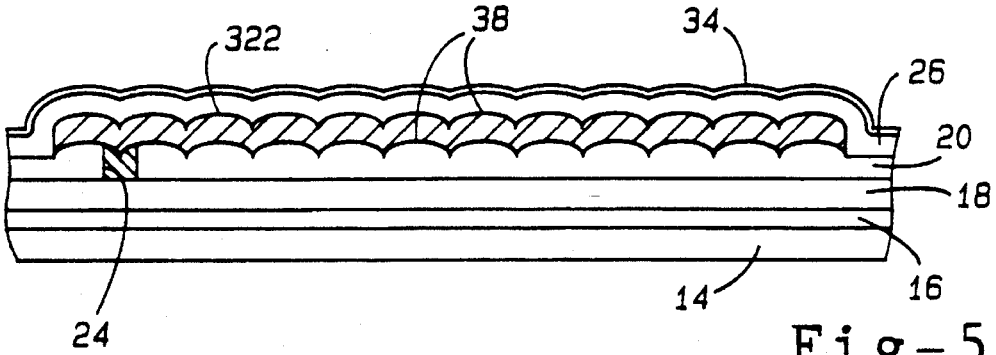

In FIG. 5, the surface of the second insulator layer 20 is uniformly texturized by depositing the insulator layer 20 beneath the pixel electrodes 322 under conditions that induce the formation of surface nodules 38. The subsequently deposited pixel electrode 322 will follow the contours of the texturized second insulator layer 20, as shown, resulting in the desired texture of the pixel electrode 322.

Figure 6:
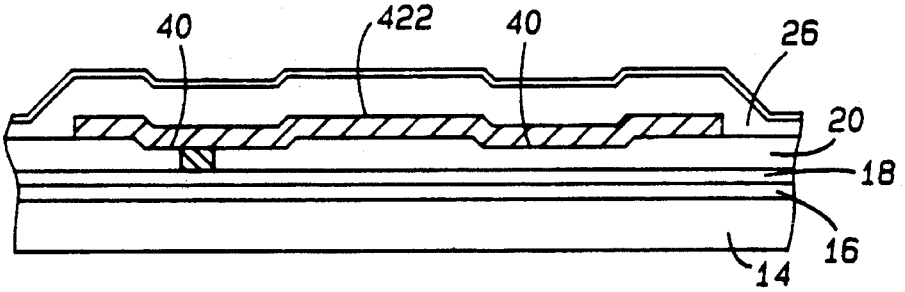

Alternatively, as shown in FIG. 6, the second insulator layer 20 may be etched, using an appropriate mask to form a plurality of parallel channels 40 or matrix of holes beneath the individual pixel electrodes 422. Although only two channels are shown in FIG. 6, it is to be understood that fifty or more channels may be etched in the second insulator layer 20 underlying each pixel electrode 422. As in the preceding embodiments, the pixel electrode 422, EL stack 26, and the transparent conductive layer will, in general, follow the contours of the texturized insulator layer.

Figure 7:
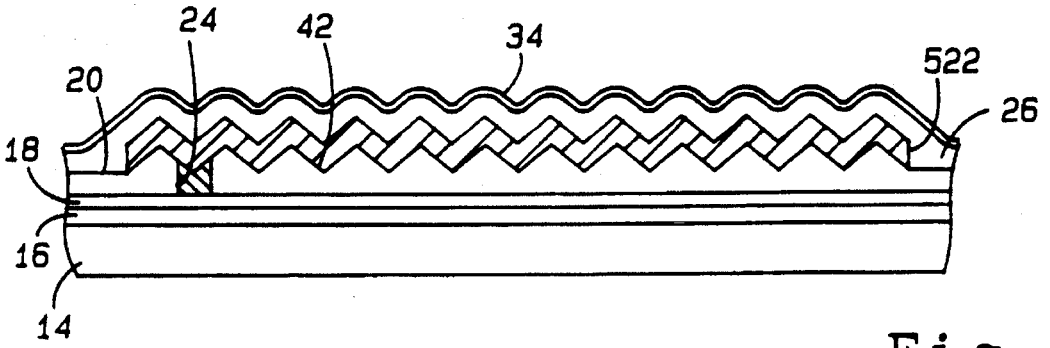
Figure 8:
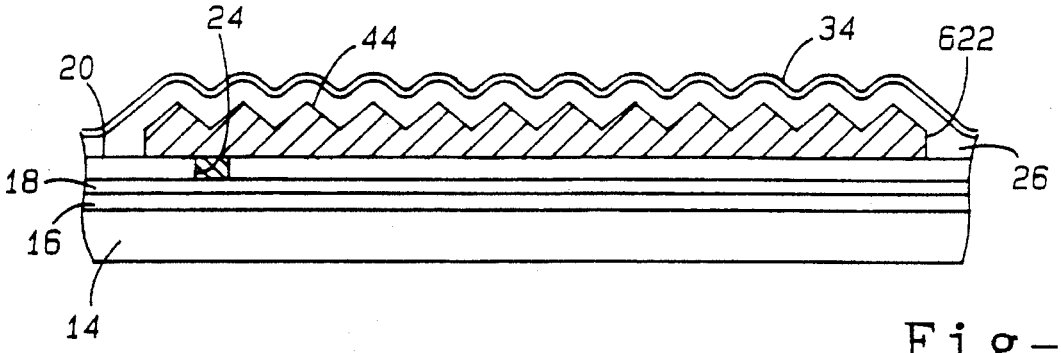

FIG. 7 is an alternate embodiment of the structural arrangement shown in FIG. 6 in which the second insulator layer 20 is texturized by etching a plurality of V-shaped grooves 42 in its upper surface below the pixel electrodes 522. Again, in this embodiment, the pixel electrode 522, EL stack 26, and transparent conductive electrode 34, follow the contour of the texturized surface of the second insulator layer. FIG. 8 is an alternate embodiment of the structure shown in FIGS. 3 and 4 in which a plurality of V-shaped grooves are etched directly in the surface of each pixel electrode 622.

FIG. 9 is a cross-section showing the details of the active semiconductor circuit formed in the silicon layer 10 under each pixel electrode, such as electrodes 22 through 622, shown in FIGS. 2 through 8. The semiconductor circuit consists of a high voltage transistor 50 and a low voltage transistor 52 formed in the silicon layer 18. The transistors 50 and 52 are electrically isolated from each other by troughs such as trough 54 etched through the silicon layer 18. The low voltage transistor 52, only a portion of which is shown, is activated by the display generator 100 when the associated pixel element is to be energized. The drain source electrode 56 connected to the drain of the low voltage transistor 52 is connected to the gate electrode 58 of the gate of the high voltage transistor 50 by means of a deposited metallic interconnection, not shown. The formation of the high voltage transistors 50, the low voltage transistor 52 in the silicon layer 18 and their interconnections are well known in the art and need not be discussed in detail for the understanding of the invention.

The source electrode 60 connected to the source of the high voltage transistor is also connected to a voltage source within the display generator 100, shown in FIG. 2, and the drain electrode 62 connected to the drain of the high voltage transistor 50 is connected to the associated pixel electrode such as pixel electrode 122 through the hole 24 etched through the second insulator layer 20. As seen in FIG. 9, the surface of the electrode 122 is irregular, following the contours of the underlying electronic circuit and will produce irregular lamination unless uniformly textured.

It is recognized that other circuits may be used to selectively apply the desired voltage to the pixel electrodes to cause the pixel to light up in response to the signals generated by the display generator 100 within the spirit of the invention.

Those skilled in the art will recognize that the surface of the pixel electrodes may be texturized using various other methods different from those illustrated in the drawings and discussed in the specification within the scope of the invention as set forth in the appended claims.

What is claimed is:

1. An active matrix electroluminescent display comprising:

a substrate;

a first insulator layer provided on said substrate;

a plurality of electronic circuits formed on said first insulator layer;

a second insulator layer disposed on said plurality of electronic circuits;

an array of metal pixel electrodes disposed on said second insulator layer, each (metal) pixel electrode of said array of pixel electrodes having a uniformly texturized surface and being associated with a respective one electronic circuit of said plurality of electronic circuits;

means for connecting each pixel electrode of said array of pixel electrodes with an output of its associated electronic circuit;

an electroluminescent stack disposed on said plurality of pixel electrodes; and a transparent conductive layer disposed on said electroluminescent stack.

2. The electroluminescent display of claim 1 wherein said array of pixel electrodes are arranged in rows and columns.

3. The electroluminescent display of claim 2 wherein each pixel electrode of said array of pixel electrodes has a plurality of holes provided in its surface to produce said texturized surface.

4. The electroluminescent display of claim 2 wherein each pixel electrode of said array of pixel electrodes has a plurality of channels etched in its surface to produce said texturized surface.

5. 7he electroluminescent display of claim 2 wherein each pixel electrode of said array of pixel electrodes has a plurality of "V" grooves etched in its surface to produce said texturized surface.

6. The electroluminescent display of claim 2 wherein said second insulator layer is deposited under conditions which induces surface nodules and wherein said plurality of pixel electrodes deposited on said surface nodules produces said texturized surface.

7. The electroluminescent display of claim 2 wherein said second insulator layer has a plurality of channels and wherein said plurality of pixel electrodes deposited on said second insulator layer assumes the contour of said second insulator layer to produce said texturized surface.

8. The electroluminescent display of claim 2 wherein said second insulator layer has a plurality of "V" grooves and wherein the deposited pixel electrodes assume the contours of said second insulator layer to product said texturized surface.

9. The electroluminescent display of claim 2 wherein each electronic circuit of said plurality of electronic circuits comprises a low voltage silicon-on-insulator device and a high voltage silicon-on-insulator device, said high voltage silicon device having an output electrically connected to its associated pixel electrode.

10. The electroluminescent display of claim 9 wherein means for connecting each pixel electrode to its associated circuit comprises a hole provided through said second insulator layer in registration with said output of said high voltage silicon-on-insulator device and wherein said associated pixel electrode makes electrical contact to said output of said high voltage silicon-on-oxide device through said hole.

* * * * *